US011832716B2

(12) United States Patent
Castex

(10) Patent No.: US 11,832,716 B2
(45) Date of Patent: Dec. 5, 2023

(54) COSMETIC APPLICATOR COMPRISING HOLES

(71) Applicant: Chanel Parfums Beauté, Neuilly-sur-Seine (FR)

(72) Inventor: Nicolas Castex, Colombes (FR)

(73) Assignee: Chanel Parfums Beauté, Neuilly-sur-Seine (FR)

( * ) Notice: Subject to any disclaimer, the term of this patent is extended or adjusted under 35 U.S.C. 154(b) by 580 days.

(21) Appl. No.: 16/473,084

(22) PCT Filed: Dec. 21, 2017

(86) PCT No.: PCT/FR2017/053784

§ 371 (c)(1),
(2) Date: Jun. 24, 2019

(87) PCT Pub. No.: WO2018/115770

PCT Pub. Date: Jun. 28, 2018

(65) Prior Publication Data

US 2019/0335885 A1 Nov. 7, 2019

(30) Foreign Application Priority Data

Dec. 22, 2016 (FR) ..... 1663182

(51) Int. Cl.

| | |
|---|---|
| ***A46B 9/02*** | (2006.01) |
| ***A46B 3/00*** | (2006.01) |
| *A45D 34/04* | (2006.01) |

(52) U.S. Cl.

CPC ..... *A46B 9/021* (2013.01); *A46B 3/005* (2013.01); *A45D 34/045* (2013.01); *A46B 2200/1053* (2013.01)

(58) Field of Classification Search

CPC .. A46B 9/00; A46B 9/02; A46B 9/021; A46B 9/023; A46B 9/025; A46B 9/026; A46B 9/028; A46B 9/06; A46B 15/00; A46B 15/0051; A46B 3/00; A46B 3/005; A46B 2200/00; A46B 2200/1046; A46B 2200/1053; A46B 2200/106; A45D 34/00;

(Continued)

(56) References Cited

U.S. PATENT DOCUMENTS 2,762,382 A * 9/1956 Morgan, Sr. ..... A45D 2/002 132/148
6,067,997 A * 5/2000 Gueret ..... A46B 9/021 132/218

(Continued)

FOREIGN PATENT DOCUMENTS

DE 202010017160 U1 4/2012
KR 20090005669 U 6/2009

(Continued)

OTHER PUBLICATIONS

International Search Report Application No. PCT/FR2017/053784 dated Apr. 17, 2018 2 Pages.

*Primary Examiner* — Cris L. Rodriguez
*Assistant Examiner* — Karim Asqiriba
(74) *Attorney, Agent, or Firm* — St. Onge Steward Johnston & Reens LLC

(57) ABSTRACT

The applicator for applying an eyelash cosmetic includes a core having a cavity and side holes connecting the cavity to the exterior of the core. The holes are disposed in a staggered arrangement.

20 Claims, 3 Drawing Sheets

(58) Field of Classification Search
CPC .. A45D 34/042; A45D 34/045; A45D 34/046; A45D 40/262; A45D 40/264; A45D 40/265; A45D 40/267
See application file for complete search history.

(56) References Cited

U.S. PATENT DOCUMENTS

| | | | | |
|---|---|---|---|---|
| 2008/0271746 | A1* | 11/2008 | Gueret | A45D 40/265 132/218 |
| 2012/0170965 | A1 | 7/2012 | Kulik et al. | |
| 2014/0016985 | A1* | 1/2014 | Osvaldo | A46D 1/0253 401/129 |
| 2014/0366910 | A1* | 12/2014 | Habibi | A46B 15/003 132/227 |
| 2016/0045014 | A1* | 2/2016 | Pires | A46B 9/021 132/320 |

FOREIGN PATENT DOCUMENTS

| | | | |
|---|---|---|---|
| WO | 2008113939 | A2 | 9/2008 |
| WO | 2013050386 | A1 | 4/2013 |

* cited by examiner

COSMETIC APPLICATOR COMPRISING HOLES

FIELD OF THE INVENTION

The invention relates to cosmetic product applicators.

BACKGROUND OF THE INVENTION

A mascara article, or "mascara", typically comprises a mascara container and an applicator. There are in particular two types of applicator, bottle brush type and injected type. A bottle brush type applicator forms a brush which comprises bristles formed by fibres trapped in a twisted metal wire forming the core of the applicator. An injected applicator is made of a single piece and comprises plastic bristles or teeth. Such applicators give the user satisfactory results. However, she is always looking for new or better make-up effects, as well as greater ease of application. Improvements include the search for better separation of the eyelashes, a better elongating and/or curving effect of the eyelashes, or a different make-up effect depending on the location of the eyelash in a row of eyelashes.

An object of the invention is therefore to improve the cosmetic product applicators.

SUMMARY OF THE INVENTION

Thus, the invention provides for an applicator for applying an eyelash cosmetic which includes a core comprising a cavity and side holes connecting the cavity to the exterior of the core, the holes being disposed in a staggered arrangement.

Thus, the holes and the cavity can be loaded with make-up product when the applicator is immersed in a container provided for this purpose. Then, during make-up, the product covering the applicator is deposited on the eyelashes. However, product is also discharged progressively from the holes. This may occur as the eyelashes pass against the holes. This may also result, where applicable, from the bending and/or compression of the core which in this case behaves rather like a sponge. The holes in fact reduce the rigidity of the core and make it more flexible. Obviously, this flexibility depends on the dimensions and or the material(s) chosen for the core.

Advantageously, the core has a cylindrical shape.

Although the invention can be implemented with a non-cylindrical core, for example a core having bulges along its length, it is advantageous to give the core a cylindrical shape. This type of shape, in fact, ensures that the make-up is loaded regularly along the applicator and makes it easier to obtain a uniform make-up effect thanks to good product distribution on the row of eyelashes.

Advantageously, the shape of the core is such that any cross-section of the core in a plane perpendicular to a main axis of the applicator is convex.

Although the invention can be implemented with a core which does not have this characteristic, it is advantageous since it ensures that the product is loaded uniformly around the applicator and simplifies the make-up by favouring a uniform deposit of the product on the eyelashes.

Preferably, at least some of the holes have a larger axis parallel to the main axis of the applicator.

Advantageously, the holes form rings extending in planes perpendicular to the main axis of the applicator, at least some of the holes having top and bottom peaks along their larger axis, the top peak of at least one of the holes being closer to a distal end of the applicator than the bottom peak of at least one hole of a higher successive ring.

Preferably, the core has a symmetrical shape of revolution.

Advantageously, the holes form rings extending in planes perpendicular to a main axis of the applicator, a distance between two holes of a ring being less than a larger dimension of one of the two holes along the plane of the ring.

Preferably, the holes form rows parallel to a main axis of the applicator, a distance between two holes of a row being less than a larger dimension of one of the two holes along the main axis.

At least some of the holes could also have a polygonal shape.

Advantageously, at least some of the holes have a diamond shape.

This shape is particularly favourable to a staggered arrangement of the holes since it optimises the arrangement of the holes on the wall of the core.

Preferably, at least some of the holes are identical, preferably all the holes being identical.

Preferably, each hole having a smaller cross-section with a normal direction directed towards the cavity, all the smaller cross-sections of the holes occupying less than half of an area of a wall of the core.

Thus, the holes occupy a relatively small surface on the applicator. This reinforces the wall of the core and preserves the strength of the applicator.

Alternatively, the holes extend over a section of the applicator forming less than half a length of the applicator.

The applicator could comprise protrusions on more than half the length of the applicator.

Thus, during the make-up, product is only reloaded on this section. On the residual section(s) therefore, the user has at her disposal areas of the applicator loaded with less product so as to be able to comb and direct the eyelashes by depositing relatively little product.

Advantageously, each hole extends over less than 20% of a revolution of the core, preferably less than 15% of a revolution, for example less than 10% of a revolution.

This prevents the eyelashes from going through the holes during make-up. Consequently, it is not the holes which comb and separate the eyelashes. These dimensions also make the applicator stronger.

Preferably, at least some of the holes have an external chamfer.

Thus, this chamfer makes it easier for the product to come out of the holes and be brought into contact with the eyelashes during make-up. Preferably, the applicator comprises protrusions, all the protrusions extend fully out of the holes.

Thus, the holes are fully available to receive product then discharge it during make-up. Thus, the protrusions which largely contribute to coating the eyelashes with the product do not interfere with the holes.

Advantageously, at least some of the holes having a diamond shape are surrounded by eight protrusions: four protrusions extending opposite four peaks of the hole and four protrusions extending opposite the middles of each side of the holes.

Preferably, the protrusions form rows parallel to a main axis of the applicator, at least some of the rows having different numbers of protrusions from the others.

Preferably, the protrusions form rings perpendicular to a main axis of the applicator, at least some of the rings having different numbers of protrusions from the others.

These two characteristic concerning the different numbers of protrusions in the rows or the rings are used to form within the rows or the rings areas which are loaded with more make-up product than the others. Local reserves for the product are therefore created, improving the coating of the eyelashes with the product without impairing the combing effect provided by the other parts of the rows or the rings which have more protrusions.

Preferably, the applicator is made in one piece.

It may be in particular an applicator made by additive synthesis, as explained below.

The invention also provides for a cosmetic article comprising a cosmetic product container and an applicator according to the invention.

The invention also provides for a method of manufacturing such an applicator by additive synthesis, comprising steps of:

obtaining data concerning the applicator; and additive synthesis of the applicator using the data.

The advantage of this type of manufacture is, in particular, that it can be used to produce applicators of complex structure, which it would be difficult or even impossible to produce by injection, considering in particular the existence of some parts with undercut.

Various additive synthesis methods known by those skilled in the art can be used to manufacture the invention. They include, for example, selective laser sintering (SLS) and stereolithography (SLA). An example of a method of manufacturing a cosmetic product applicator by additive synthesis is described in application WO 2008/113939 in the name of the applicant.

The invention also provides for a computer file comprising data that can be used by a computer program to control the implementation of the method according to the invention.

The invention also provides for an electronic storage medium comprising stored data to implement such a method.

Lastly, the invention also provides for a method of obtaining such a file in order to download it on a telecommunication network.

BRIEF DESCRIPTION OF THE DRAWINGS

We will now describe one embodiment of the invention and an alternative given as non-limiting examples referring to the attached figures, on which.

DETAILED DESCRIPTION OF THE INVENTION

Figure 1:
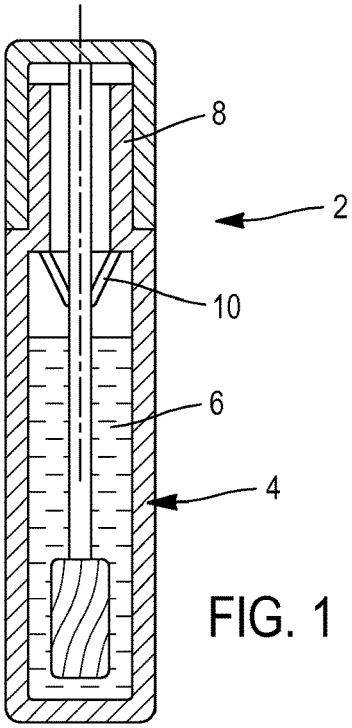
FIG. 1 is a longitudinal cross-section of a cosmetic article according to one embodiment of the invention.
Figure 2:
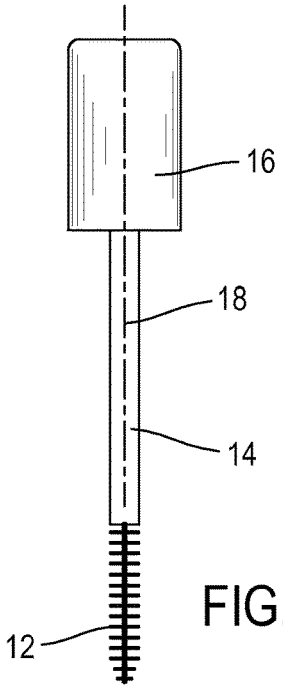
FIG. 2 is a side view of an applicator of the article of FIG. 1 with its rod and the plug of the container.

A first embodiment of the cosmetic article according to the invention is illustrated on FIGS. 1 to 8.

The article 2 comprises a bottle 4 having a container for a cosmetic product 6 which in this case is mascara. The top of the bottle has a neck 8 of diameter less than the largest transverse dimension of the bottle 4. The article comprises a wiper 10, for example of frustoconical shape, attached inside the neck 8.

The article comprises an applicator 12 attached to the end of a rod 14 which carries a plug 16 at its other end. The article is configured so that the plug 16 can be screwed onto the neck 8 in a position in which the distal end part of the rod 14 and the entire applicator 12 dip into the product 6. This configuration is shown on FIG. 1. The article is then closed.

We will now describe the applicator 12 in more detail. The latter has a longitudinal axis 18 which coincides with that of the rod 14, the plug 16 and the entire article 2.

The applicator comprises a core or body 20. The core has a generally symmetrical shape of revolution about the axis 18.

The core comprises a wall having an outer side 22 which in this case has a cylindrical shape. In addition, the core is formed so that any cross-section of the core in a plane perpendicular to the axis is convex. The outer side 22 has a cross-section of generally circular shape perpendicular to the axis. The core is therefore generally sleeve- or tube-shaped.

The core 20 is hollow. The wall has an inner side also of cylindrical shape with circular cross-section in a plane perpendicular to the axis 18. The core thus defines a cavity. This cavity is blocked at the two axial ends of the core as shown in particular on FIG. 3.

The wall of the core is perforated. It therefore has openings or holes 24 which are through-holes so that they each connect the cavity of the core to the exterior of the core.

In this case, all the holes are identical. In this case, they have the shape of a polygon, a quadrilateral, or even a diamond. The diamond is arranged so that its longer diagonal is parallel to the axis 18 such that its shorter diagonal extends in the circumferential direction of the core.

Figure 5:
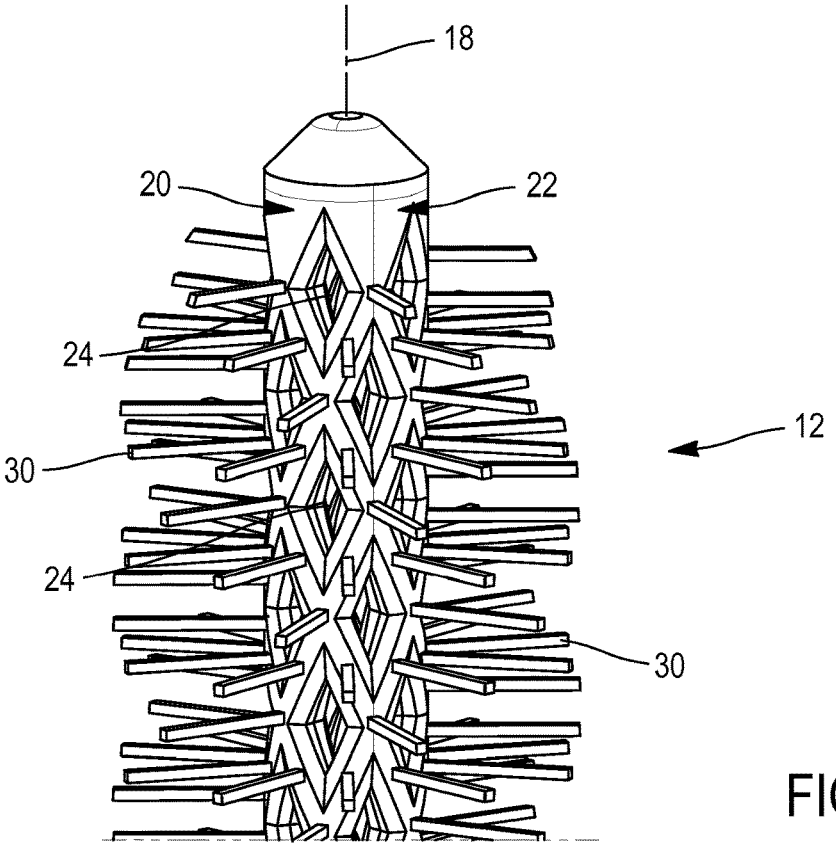
Figure 6:
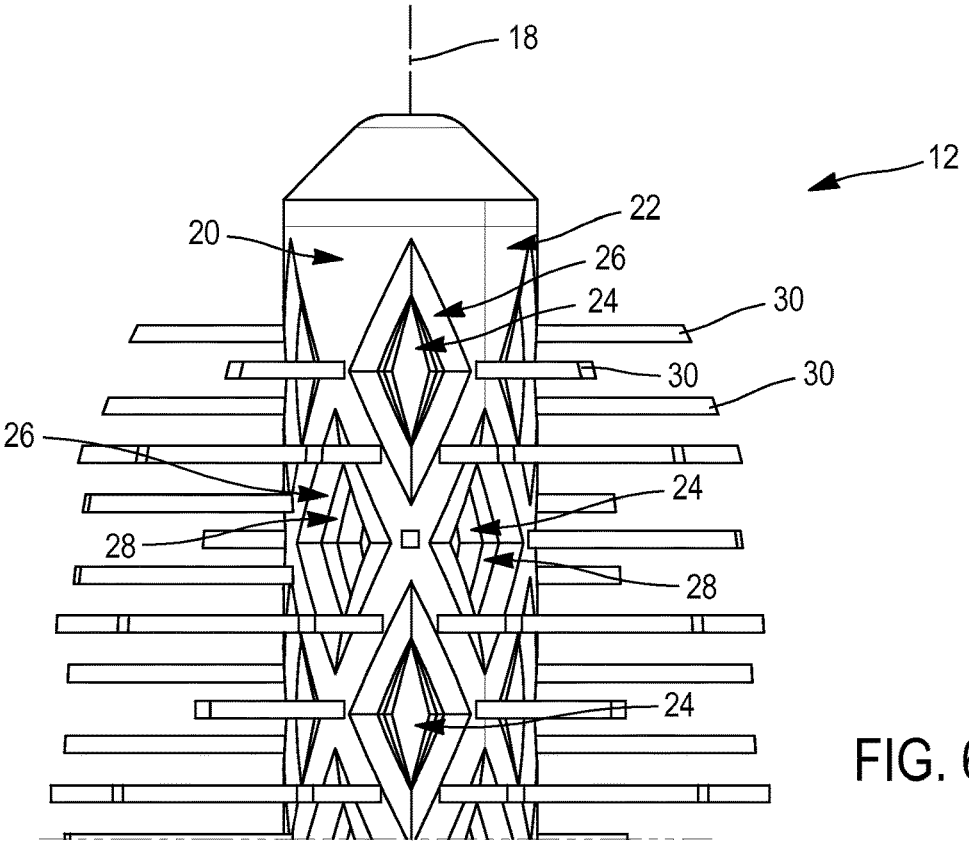

As shown in particular on FIGS. 5 and 6, each hole is chamfered. It thus has a first chamfer, external chamfer or main chamfer 26 contiguous to the outer side 22 of the core. This chamfer is itself extended towards the inside of the hole by a second chamfer 28 or internal chamfer. The part of the hole which follows this second chamfer is therefore that with the smallest cross-section amongst the various cross-sections of the hole. This cross-section is taken in a plane perpendicular to the direction radial to the axis 18. This latter direction is therefore directed towards the cavity. In other words, this cross-section has a normal direction directed towards the cavity and the axis.

The number of holes 24 and their dimensions are chosen so that all these smallest cross-sections occupy less than half of a total area of the outer side of the core. This is shown for example on FIG. 8 on which the core has been fictitiously unwound in a plane. In other words, the lateral area of the core is occupied mainly by the solid portions of the side 22 and not by the holes 24.

In addition, the dimensions of each hole are chosen so that it extends over less than 20% of a revolution of the core, preferably less than 15% of a revolution, for example less than 10% of a revolution. In this case, the small diagonal of the diamond which forms its larger dimension in the circumferential direction is in a ratio of 4 to 45 with respect to the total dimension of the circumference of the core, so that this dimension extends over 8.89% of a revolution of the core. In this case, these measurements are taken on the inner edge of the external chamfer so that, if the same measurement is taken on the smallest cross-section of the hole, the above-mentioned ratio is even smaller. If the measurement is taken on the outer edge of the external chamfer, we change to a ratio of 6 to 45, i.e. about 13.3%.

The holes 24 are arranged so that they form straight rows parallel to the axis 18. In addition, they are arranged so that they form rings of holes around the axis 18, the holes in a given ring extending in the same plane. In addition, the holes are disposed in a staggered arrangement. Thus, the holes of a row are offset by a half unit along the direction of the axis relative to those of the two adjacent rows, the unit being defined as the distance separating the centres of two adjacent holes of a given row. Similarly, the holes of a ring are offset by a half unit along the circumferential direction relative to those of the two adjacent rings, the unit being defined as the distance separating the centres of two adjacent holes of a given ring.

In this case, all the rows comprise seven holes 24. There are 10 rows. There are 14 rings and each ring comprises five holes. There are therefore 70 holes.

Obviously, this number is not limiting. More generally, there could be between 15 and 280 holes, even between 30 and 140, or even between 60 and 90.

The arrangement of the rows and rings and the dimensions of the holes 24 are chosen so that the diamonds also form helical rows. In addition, in each helical row, two opposite sides of the diamonds are co-linear with each other. If we consider any group of four holes closest to each other, their centres form a diamond which has the same proportions as the diamond of each hole.

We therefore see that the holes form a lattice and a mesh.

For example, the diamonds could have diagonals of length 0.9 mm×0.4 mm.

The applicator also comprises protrusions 30 forming in this case bristles. All the protrusions extend from the outer side 22 and none of them extends into one of the holes 24, not even from one of the chamfers. Except in a distal end area of the applicator in which the protrusions have a reduced length, all the protrusions of the applicator have the same length. In this case, this length is more than 80% of the core diameter and more generally greater than 50% of this diameter.

All the protrusions 30 extend in a direction radial to the axis 18 and are perpendicular to this axis.

The protrusions are arranged as follows.

Figure 8:
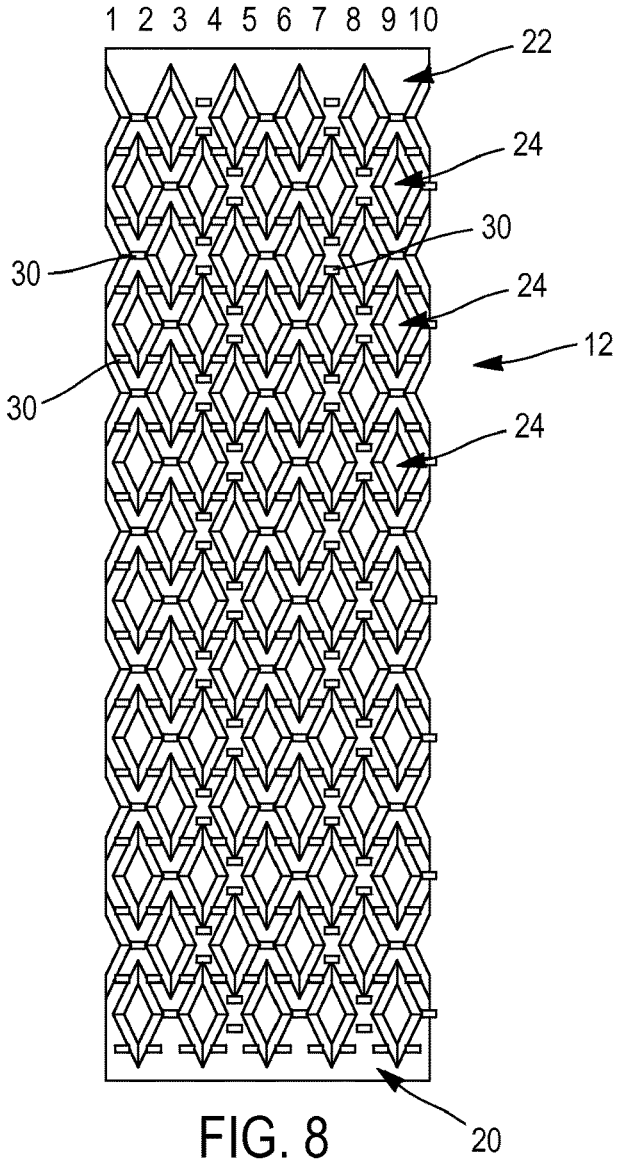
FIG. 8 is a view of the core of the applicator of FIG. 3, unwound on a plane.

On FIG. 8, the ten rows of holes from left to right have been numbered from 1 to 10.

In row No. 1, a protrusion 30 extends between each pair of consecutive diamonds of the row. However, the protrusion extends at a distance from the ends of these diamonds. However, it is contiguous to the ends of the adjacent diamond of the two adjacent rows.

In the next row No. 2, the protrusions 30 are arranged in the same way.

In row No. 3, it is this time two protrusions 30 which extend between each pair of consecutive diamonds of the row and each protrusion is contiguous to one of the diamonds considered.

In row No. 4, the protrusions are arranged in the same way.

In rows No. 5, 6, 9 and 10, the protrusions are arranged in the same way as those of rows No. 1 and 2.

In rows No. 7 and 8, the protrusions are arranged in the same way as those of rows No. 3 and 4.

In addition, the other protrusions 30, which will be called the intermediate protrusions, are arranged between the sides opposite the adjacent diamonds of two rows. Thus, for each pair of sides considered, there is a protrusion contiguous to these two sides. These secondary protrusions form rings of protrusions extending in the same plane perpendicular to the axis 18 and comprising none of the other protrusions.

Due to this arrangement, the protrusions therefore form straight rows parallel to the axis 18, some rows having the same number of protrusions and others not. Thus, rows No. 1 and 2 both have seven protrusions. There are 14 protrusions in rows No. 3 and 4. There are also 14 protrusions in each row of the intermediate protrusions. This makes a total of 18 rows of protrusions 30.

Figure 7:
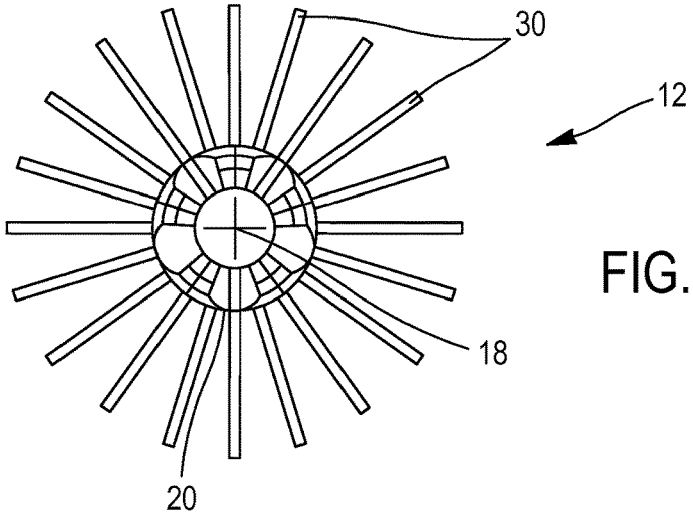
FIG. 7 is an end view of the applicator of FIG. 3.

As shown in particular on FIG. 7, with this arrangement, these rows are uniformly distributed around the axis.

Similarly, these protrusions 30 form rings extending in respective planes perpendicular to the axis 18, some rings having the same number of protrusions and others not. Thus, each ring of intermediate protrusions comprises 10 protrusions. In other rings, there are sometimes two protrusions and sometimes three. This makes a total of 42 rows of protrusions 30.

Obviously, all these figures concerning the number of holes per row and per ring and the number of protrusions per row and per ring are not limiting and numerous other configurations are possible.

This applicator is made in one piece. It is for example made of plastic.

The article is used for making up the eyelashes or eyebrows. At rest, the article is in the configuration shown on FIG. 1, with the applicator 12 immersed in the mascara 6 of the container. The cavity of the applicator and the holes 24 are filled with mascara.

To use the article, the user unscrews the cap 16 then takes the applicator 12 out of the container. As the applicator is taken out, it is wiped through the wiper 10 to remove the excess mascara. This wiping removes the excess product from the protrusions 30 but leaves most of the product which is in the holes 24 and in the cavity.

The user then places the applicator on the eyelashes to deposit the mascara. The product coating the protrusions is therefore progressively transferred onto the eyelashes. During this movement, some of the product contained in the holes is transferred by capillarity onto the side 22 and onto the protrusions. In addition, the eyelashes may move to the surface of the holes to be directly loaded with mascara. Since the applicator dimensions and material are chosen to give it a certain degree of flexibility, the applicator cross-section undergoes bending and contraction movements which also force more product to move from the cavity to the holes, then to the outside of the core. Consequently, there is no need to reload the applicator frequently with mascara by dipping it into the container. The holes 24 and the cavity help in fact to progressively supply the protrusions 30 and the eyelashes with mascara as it is deposited on the eyelashes. In this respect, the applicator behaves rather like a sponge and discharges mascara out of its holes during the make-up. In addition, the rows of protrusions also help to comb and separate the eyelashes to avoid the formation of clumps. They favour a regular coating of the eyelashes with mascara to make them look longer and thicker.

Figure 3:
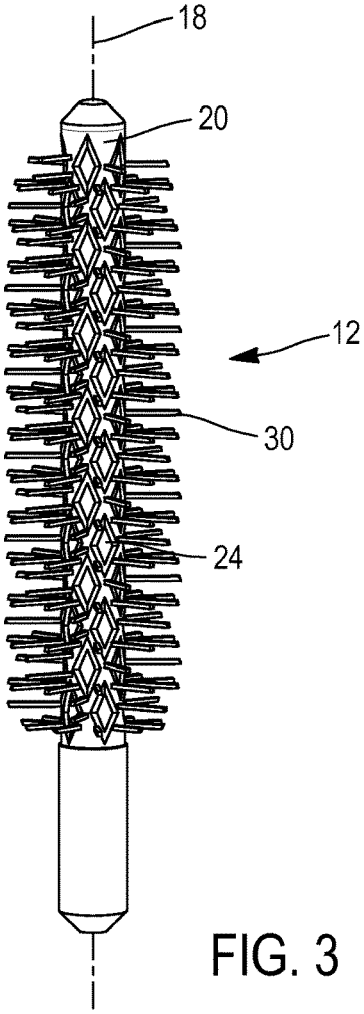
FIGS. 3 to 6 are views on a larger scale of the applicator of FIG. 2.
Figure 4:
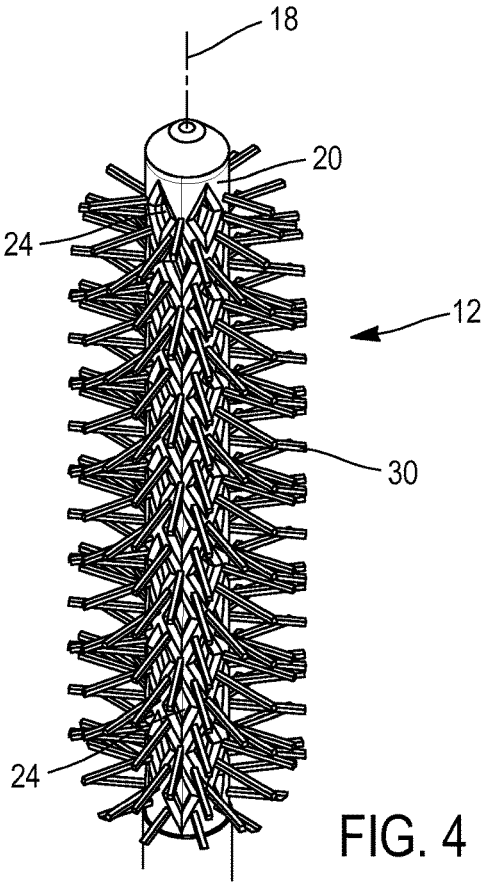
Figure 9:
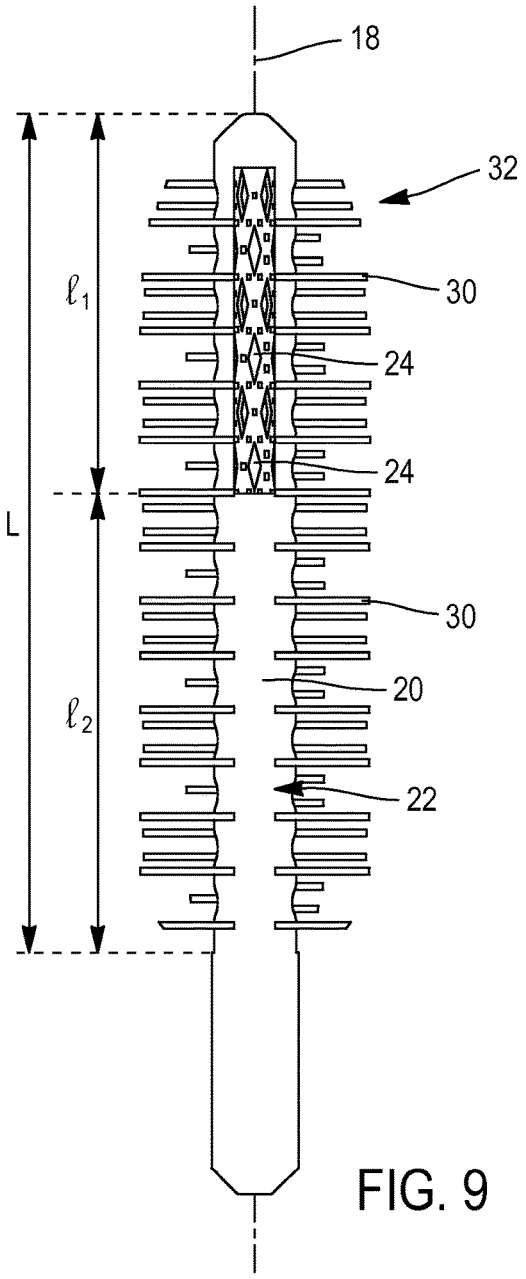
FIG. 9 is a view similar to FIG. 3 showing an alternative embodiment of the applicator according to the invention.

In the alternative of FIG. 9, the applicator 20 only differs from that shown on FIG. 3 by the fact that the holes are present only in reduced portions of the applicator. Thus, the applicator has no holes over more than half its length, the holes extending only in the distal end section.

This section has a length l1 which represents less than half the total length L of the applicator. The lower part of the applicator on FIG. 9 is not taken into account for this total length since it is inserted into the end of the rod and thus does not play a role in the make-up.

In addition, in the distal end section, the holes 24 do not extend around the entire circumference of the applicator. The holes are arranged on a reduced number of cylindrical sectors, four in this case, regularly distributed around the axis 18. On the sector shown on FIG. 9, there are nine holes 24. In this case therefore, the applicator only comprises 36 holes. More generally, such an applicator may comprise a number of holes between 15 and 140 for example. However, the arrangement and number of protrusions is unchanged. Obviously, it would nevertheless also be possible to modify the number and/or arrangement of the protrusions.

In this alternative, the product reloading effect produced by the holes 24 and the cavity at the distal end section of the applicator is preserved while the applicator comprises protrusions 30 over most of its total length L. We therefore obtain an applicator which is loaded with more mascara on leaving the container and during make-up on the distal end section provided with holes than on the rest of the applicator which also has protrusions 30 but no holes 24.

The applicators described above are manufactured in one piece. More particularly, these applicators are manufactured in this case by additive synthesis, also known as 3D printing.

Any suitable material can be used to manufacture these applicators. It may be a plastic, for example a polyamide, in particular a polyamide 1102, a PEBA 2301, or an ABS type resin, or a powdered metal such as a stainless steel or titanium. For example, polyamide 11 (polyundecanamide, nylon 11, PA 11, sometimes called "French nylon" which is a thermoplastic polymer from the family of aliphatic polyamides could be chosen.

The material may be rigid but will preferably be elastically flexible. Preferably, the material, in combination with the applicators shape characteristics, gives the applicator a certain degree of flexibility.

Note that the length of a mascara applicator is generally less than 20 mm.

Several additive synthesis methods may be used to manufacture an applicator as described previously. We may mention in particular selective laser sintering from powdered material, and stereolithography (SLA). In the present case, a selective laser sintering method is used, this method offering the advantage of allowing objects of complex shape to be manufactured.

The applicator is first designed using computer-aided design (CAD) software. A file in STL format with the applicator design data is therefore created and then exported. These data determine the shape of the applicator. Other standard file formats for additive synthesis may be used.

This file is then processed by software supplied by the manufacturer of the machine used to carry out the additive synthesis. This software breaks down the file into sections in the form of about hundred digital images in SLI or BFF format, each image corresponding to a layer of the model to be printed, i.e. to a section of the applicator taken in a plane perpendicular to the longitudinal axis of the applicator. These data are then sent to the printer to produce the applicator.

Once the synthesis is finished, treatments may be applied to the applicator, for example to improve its appearance.

Obviously, numerous modifications can be made without leaving the scope of the invention.

The applicator could be given a shape which is not cylindrical, whose cross-section is not circular and/or which does not have a symmetrical shape of revolution. The applicator cross-section could for example have an elliptical shape.

The holes 24 will not necessarily have a quadrilateral or even polygonal shape. They could for example have a circular or square shape. Some of the holes of a given applicator according to the invention could have shapes that are different from each other.

Although the applicators shown here are generally straight, they could have a non-linear shape, for example a curved or wavy shape.

Although the above-mentioned applicators have been described as comprising identical protrusions 30 forming bristles, these protrusions could also form teeth or the applicator could comprise some protrusions forming bristles and others forming teeth.

The invention claimed is:

1. An applicator for applying an eyelash cosmetic, including a core comprising a cavity and side holes connecting the cavity to an exterior of the core, the side holes being disposed in a staggered arrangement, wherein at least some of the side holes have at least an external chamfer contiguous on an outer side of the core, the external chamfer forming a slope towards the interior of the core at edges of the holes on the outer side of the core, according to an inward facing angle, the external chamfer extending towards an inside of the core and an internal chamfer adjacent the external chamfer and the internal chamfer forms a different angle to said external chamfer.

2. The applicator according to claim 1, wherein the shape of the core is such that any cross-section of the core in a plane perpendicular to a main axis of the applicator is convex.

3. The applicator according to claim 1, wherein at least some of the side holes have a larger axis parallel to a main axis of the applicator.

4. The applicator according to claim 3, wherein the side holes form rings extending in planes perpendicular to the main axis of the applicator, at least some of the side holes having top and bottom peaks along their larger axis, the top peak of at least one of the side holes being closer to a distal end of the applicator than the bottom peak of at least one side hole of a higher successive ring.

5. The applicator according to claim 1, wherein the side holes form rings extending in planes perpendicular to a main axis of the applicator, a distance between two side holes of a ring being less than a larger dimension of one of the two side holes along the plane of the ring.

6. The applicator according to claim 1, wherein the side holes form rows parallel to a main axis of the applicator, a distance between two side holes of a row being less than a larger dimension of one of the two side holes along the main axis of the applicator.

7. The applicator according to claim 1, wherein at least some of the side holes have a polygonal shape.

8. The applicator according to claim 1, wherein at least some of the side holes have a diamond shape.

9. The applicator according to claim 8, wherein at least some of the side holes having a diamond shape are surrounded by eight protrusions: four protrusions extending opposite four peaks of the side hole and four protrusions extending opposite a middle of each side of the side holes.

10. The applicator according to claim 1, wherein at least some of the side holes are identical.

11. The applicator according to claim 1, wherein each side hole has a smaller cross-section with a normal direction directed towards the cavity, and a sum of the areas of all the smaller cross-sections of the side holes is less than half of a total area of a wall of the core.

12. The applicator according to claim 1, wherein the side holes extend over a section of the applicator forming less than half a length of the applicator, the applicator comprising protrusions on more than half the length of the applicator.

13. The applicator according to claim 1, wherein each side hole extends over less than 20% of a revolution of the core.

14. The applicator according to claim 1, further comprising protrusions extending fully out of the side holes.

15. The applicator according to claim 1, which comprises protrusions forming rows parallel to a main axis of the applicator, at least some of the rows having different numbers of protrusions from the others.

16. The applicator according to claim 1, which comprises protrusions forming rings perpendicular to a main axis of the applicator, at least some of the rings having different numbers of protrusions from the others.

17. The applicator according to claim 1, and made in one piece.

18. A cosmetic article comprising a cosmetic product container and an applicator according to claim 1.

19. The applicator according to claim 1, wherein each side hole extends over less than 15% of a revolution of the core.

20. The applicator according to claim 1, wherein each side hole extends over less than 10% of a revolution of the core.

* * * * *